US012760382B2

(12) United States Patent
Hoche et al.

(10) Patent No.: US 12,760,382 B2
(45) Date of Patent: Oct. 13, 2026

(54) FORGED PART OF STEEL AND A METHOD OF MANUFACTURING THEREOF

(71) Applicant: ArcelorMittal, Luxembourg (LU)

(72) Inventors: Francois-Xavier Hoche, Metz (FR); Didier Forgeoux, Jarville la Malgrange (FR); Victor Bordereau, Schwerdorff (FR); Bernard Resiak, Saulny (FR)

(73) Assignee: ArcelorMittal, Luxembourg (LU)

( * ) Notice: Subject to any disclaimer, the term of this patent is extended or adjusted under 35 U.S.C. 154(b) by 503 days.

(21) Appl. No.: 18/024,810

(22) PCT Filed: Sep. 7, 2020

(86) PCT No.: PCT/IB2020/058301
§ 371 (c)(1),
(2) Date: Mar. 6, 2023

(87) PCT Pub. No.: WO2022/049412
PCT Pub. Date: Mar. 10, 2022

(65) Prior Publication Data

US 2023/0323493 A1 Oct. 12, 2023

(51) Int. Cl.
*C21D 7/13* (2006.01)
*C21D 1/18* (2006.01)
(Continued)

(52) U.S. Cl.
CPC ..... *C21D 7/13* (2013.01); *C21D 1/18* (2013.01); *C21D 1/84* (2013.01); *C21D 6/002* (2013.01);
(Continued)

(58) Field of Classification Search
None
See application file for complete search history.

(56) References Cited

U.S. PATENT DOCUMENTS 5,213,634 A * 5/1993 DeArdo ..... C22C 38/22 148/334
6,248,191 B1 * 6/2001 Luton ..... C21D 1/19 148/653
(Continued)

FOREIGN PATENT DOCUMENTS

CN 1265708 A 9/2000
EP 2576848 B1 12/2016
(Continued)

OTHER PUBLICATIONS

Search Report of PCT/IB2021/058301 of Oct. 5, 2021 and International Report on Patentability.

*Primary Examiner* — Devang R Patel
(74) *Attorney, Agent, or Firm* — Davidson Kappel LLC

(57) ABSTRACT

A steel for forging mechanical parts including of the following elements 0.04%≤C≤0.28%; 1.2%≤Mn≤2.2%; 0.3%≤Si≤1.2%; 0.5%≤Cr≤1.5%; 0.01%≤Ni≤1%; 0%≤S≤0.06%; 0%≤P≤0.02%; 0%≤N≤0.015%; 0%≤Al≤0.1%; 0.03%≤Mo≤0.5%; 0%≤Cu≤0.5%; 0.04%≤Nb≤0.15%; 0.01%≤Ti≤0.1%; 0%≤V≤0.5%; 0.0015%≤B≤0.004%; the remainder composition being composed of iron and unavoidable impurities caused by processing, the microstructure of the steel having microstructure including in area fraction, 55% to 85% of Martensite, 20% to 45% of Auto-tempered Martensite, 0 to 10% Residual Austenite and, wherein cumulated amounts of Auto-tempered martensite and martensite is at least 90%.

18 Claims, 1 Drawing Sheet

(51) Int. Cl.

| | |
|---|---|
| ***C21D 1/84*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C21D 6/004* (2013.01); *C21D 6/005* (2013.01); *C21D 6/008* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/28* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/008* (2013.01)

(56) References Cited

U.S. PATENT DOCUMENTS

| | | | | |
|---|---|---|---|---|
| 7,314,532 | B2 * | 1/2008 | Ikeda | C22C 38/06 148/333 |
| 9,121,087 | B2 * | 9/2015 | Matsuda | C21D 1/19 |
| 9,200,343 | B2 * | 12/2015 | Matsuda | C22C 38/26 |
| 2010/0183473 | A1 | 7/2010 | Teramoto et al. | |
| 2011/0146852 | A1 * | 6/2011 | Matsuda | C22C 38/04 148/333 |
| 2013/0048161 | A1 | 2/2013 | Matsuda et al. | |
| 2013/0087253 | A1 * | 4/2013 | Matsuda | C23C 2/28 148/333 |
| 2018/0202017 | A1 | 7/2018 | Drillet et al. | |
| 2018/0327873 | A1 | 11/2018 | Reichel et al. | |

FOREIGN PATENT DOCUMENTS

| | | | | |
|---|---|---|---|---|
| JP | H0336233 | A | 2/1991 | |
| JP | H0336234 | A | 2/1991 | |
| JP | 2009108357 | A | 5/2009 | |
| WO | WO-2009096596 | A1 * | 8/2009 | C23C 2/06 |
| WO | WO2016063224 | A1 | 4/2016 | |
| WO | WO-2016103534 | A1 * | 6/2016 | C22C 18/00 |
| WO | WO-2018117552 | A1 * | 6/2018 | C22C 38/38 |

* cited by examiner

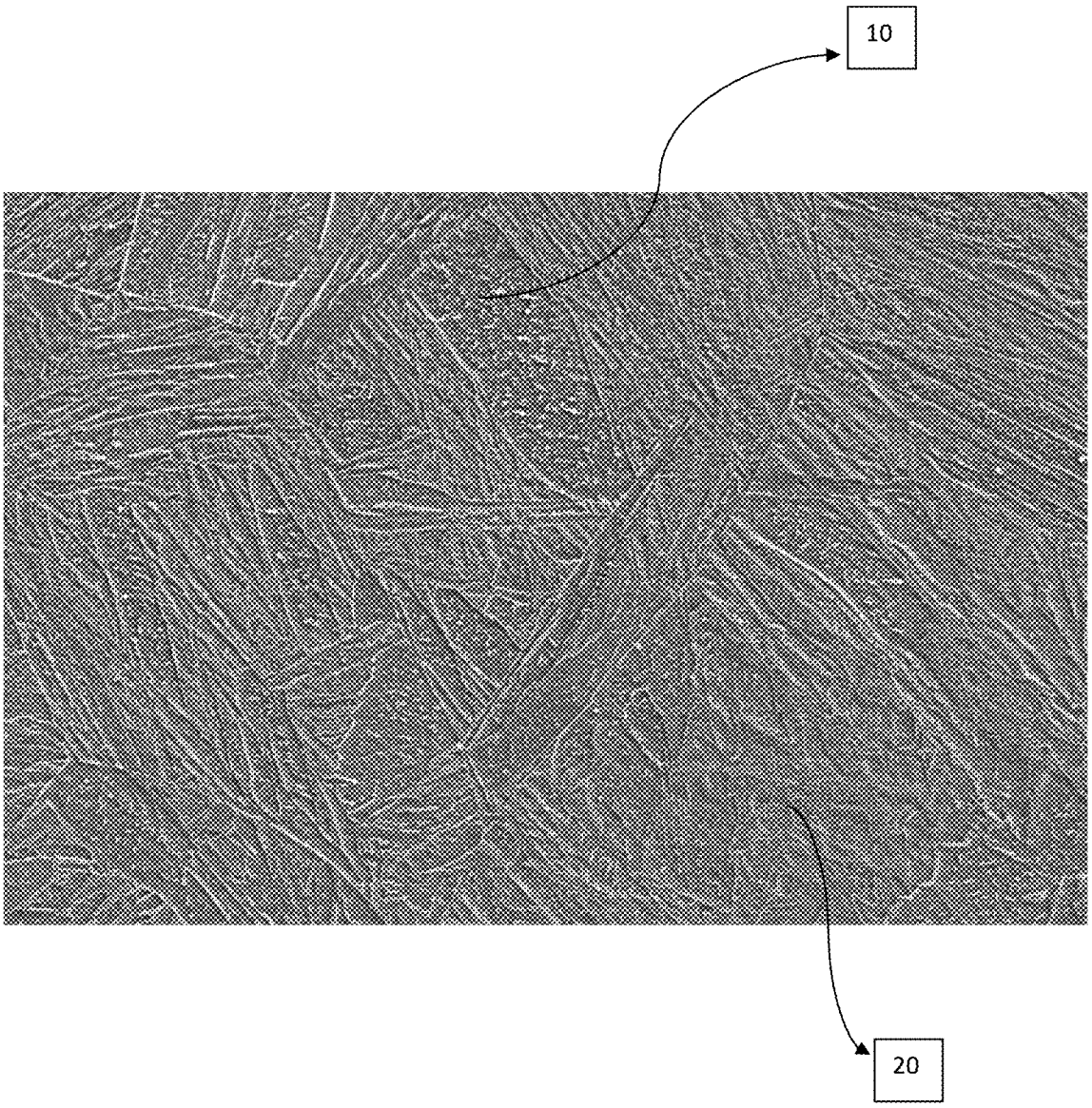
10
20

FORGED PART OF STEEL AND A METHOD OF MANUFACTURING THEREOF

The present invention relates to steel suitable for forging mechanical parts of steel for automobiles.

BACKGROUND

Automotive parts are required to satisfy two inconsistent necessities, namely ease of forming and strength, but in recent years a third requirement of improvement in fuel consumption is also bestowed upon automobiles in view of global environment concerns. Thus, now automotive parts must be made of material having high formability in order to fit in the criteria of ease of fit in the intricate automobile assembly and at same time have improved strength for vehicle's engine crashworthiness and durability while reducing weight of vehicle to improve fuel efficiency.

Therefore, intense Research and development endeavors are put in to reduce the amount of material utilized in car by increasing the strength of material. Conversely, an increase in strength of steel decreases formability, and thus development of materials having high strength, high impact toughness as well as high formability is necessitated.

Earlier research and developments in the field of high strength and high impact toughness have resulted in several methods for producing high strength and high impact toughness steel, some of which are enumerated herein for -appreciation of the present invention:

U.S. Pat. No. 7,314,532 is a high-strength forged part comprising a base phase structure and a second phase structure and containing C: 0.41% to 0.6%, Si+Al: 0.5% to 3%, Mn: 0.5% to 3%, P: 0.15% or less (not including 0%),S: 0.02% or less (including 0%), wherein the base phase structure contains 30% or more of ferrite in terms of a space factor relative to the entire structure, the second phase structure comprises retained austenite, as well as bainite and/or martensite, the content of the retained austenite is represented by the following expression (1) relative to the entire structure, an average grain diameter, d, of the second phase structure is 5 μm or less, and a space factor of a coarse portion of (1.5×d) or more in an average grain diameter contained in the second phase structure is 15% or less $0\times[C]<[V_{yR}]<150\times[C]-(1)$ where $[V_{yR}]$ stands for a space factor of the retained austenite relative to the entire structure and [C] stands for the content (mass %) of C in the forged part. But the steel of U.S. Pat. No. 7,314,532 is not able to reach the tensile strength.

WO2016/063224 claims for a steel comprising of chemical composition in weight percentages: 0.1≤C≤0.25%, 1.2≤Mn≤2.5%, 0.5≤Si≤1.7%, 0.8≤Cr≤1.4%, 0.05≤Mn≤0.1, 0.05≤Nb≤0.10, 0.01≤Ti≤0.03%, 0Ni≤0.4, 0<V≤0.1%, 0<S≤0.03%, 0<P≤0.02%, 0<B≤30 ppm, 0<O≤15 ppm and the residual elements less than 0.4%. But in term of mechanical properties the tensile strength is below 1200 MPa, the yield strength never goes higher than 800 MPa.

SUMMARY OF THE INVENTION

In the light of the publications mentioned above, it is an object of the present disclosure to provide a bainitic steel for hot forging of mechanical parts that makes it possible to obtain tensile strength above 1300 MPa and impact toughness 38 J at 20° C. in KCV.

Hence the purpose of the present invention is to solve these problems by making available a bainitic steel suitable for hot forging that simultaneously has:

- an ultimate tensile strength greater than or equal to 1300 MPa and preferably above 1400 MPa,
- an impact toughness greater than or equal to 38 J at 20° C. and preferably greater than 40 J at 20° C., and
- a yield strength to tensile strength ratio of 0.8 or less and preferably 0.75 or less.

In a preferred embodiment, the steel sheets according to the invention may also present a yield strength greater than or equal to 800 MPa and preferably above 850 MPa.

Preferably, such steel is suitable for manufacturing forged steel parts having a cross section between 10 mm and 100 mm such as a connecting rod, pitman arm and steering knuckle without a noticeable hardness gradient between a forged part skin and heart.

Another object of the present invention is to make available a method for the manufacturing of these mechanical parts that is compatible with conventional industrial applications while being robust towards manufacturing parameters shifts.

DETAILED DESCRIPTION

Carbon is present in the steel of the present invention from 0.04% to 0.28%. Carbon imparts strength to the steel by solid solution strengthening and carbon is gammagenous hence delays the formation of Ferrite. Carbon is the element that has the impact on Martensitic start transformation temperature (Ms). Martensite transformed at low temperature exhibits better strength and ductility in combination with auto tempered martensite transformed at high temperature especially below Ms. A minimum of 0.04% of carbon is required to reach a tensile strength of 1300 MPa but if carbon is present above 0.28%, carbon deteriorates ductility as well as machinability of the final product due to the formation of cementite. The carbon content is advantageously in the range 0.08% to 0.25% to obtain simultaneously high strength and high ductility and more preferably between 0.09% and 0.22%.

Manganese is added in the present steel between 1.2% and 2.2%. Manganese provides hardenability to the steel. It allows to decrease the critical cooling rate for which a martensitic transformation can be obtained in continuous cooling without any prior transformation. A minimum content of 1.2% by weight is necessary to obtain the desired martensite microstructure and also stabilizes austenite. But above 2.2%, manganese has a negative effect on the steel of the present invention as retained austenite can transform into bainite as well as MA islands and these phases are detrimental for the properties. In addition, manganese forms sulphides such as MnS. These sulphides can increase machinability if the shape and distribution are well controlled. If not, they might have a very detrimental effect on impact toughness. The preferred limit of manganese is between 1.4% and 2.1% and more preferably between 1.5% and 1.9%.

Silicon is present in the steel of the present invention between 0.3% and 1.2%. Silicon impart the steel of the present invention with strength through solid solution strengthening. Silicon reduces the formation of cementite nucleation as silicon hinders precipitation and diffusion-controlled growth of carbides by forming a Si-enriched layer around precipitate nuclei. Therefore, austenite gets enriched in carbon which reduces the driving force during the bainitic transformation. As a consequence, addition of Si slows down the overall bainitic transformation kinetics which leads to an increase in the formation of martensite. Silicon also acts as a deoxidizer. A minimum of 0.3% of silicon is required to impart strength to the steel of the present invention and to provide retardation for formation of bainite under continuous cooling. An amount of more than 1.2% raises the activity of carbon in austenite promoting its transformation into pro-eutectoid ferrite, which can deteriorate the strength, and also resulting in too much retained austenite at the end of cooling. The preferred limit for Silicon between 0.3 and 1% and more preferably between 0.3% and 0.9%

Chromium is present between 0.5% and 1.5% in the steel of the present invention. Chromium is an indispensable element in order to produce martensite and impart toughness to the steel of the present invention. Addition of Chromium promotes homogeneous and finer martensite microstructure during the temperature range between Ms and room temperature. A minimum content of 0.5% of Chromium is required to produce the targeted martensitic microstructure but the presence of Chromium content of 1.5% or more causes segregation. It is advantageous to have Chromium between 0.7% and 1.4% and more preferably between 0.8% and 1.3%.

Nickel is contained between 0.01% and 1%. It is added to contribute towards hardenability and toughness of steel. Nickel also assists in lowering the bainite start temperature. However, its content is limited to 1%, due to the economic feasibility. It is preferable to have nickel between 0.01% and 0.8% and more preferably between 0.01% and 0.7%.

Sulphur is contained between 0% and 0.06%. Sulphur forms MnS precipitates which improve the machinability and assists in obtaining a sufficient machinability. During metal forming processes such as rolling and forging, deformable manganese sulfide (MnS) inclusions become elongated. Such elongated MnS inclusions can have considerable adverse effects on mechanical properties such as tensile strength and impact toughness if the inclusions are not aligned with the loading direction. Therefore, sulfur content is limited to 0.06%. A preferable range the content of Sulphur is 0.03% to 0.04%.

Phosphorus is an optional constituent of the steel of the present invention and is between 0% and 0.02%. Phosphorus reduces the spot weldability and the hot ductility, particularly due to its tendency to segregate at the grain boundaries or co-segregate with manganese. For these reasons, its content is limited to 0.02% and preferably lowers than 0.015%.

Nitrogen is in an amount between 0% and 0.015% in steel of the present invention. Nitrogen forms nitrides with Al, Nb, and Ti, which prevent the austenite structure of the steel from coarsening during hot forging and enhance the toughness thereof. An efficient use of TiN to pin austenite grain boundaries is achieved when the Ti content lies between 0.01% and 0.03% together with a Ti/N ratio<3.42. Using an over-stoichiometric nitrogen content leads to an increase in the size of these particles, this is not only less efficient to pin the austenite grain boundaries but also increases the probability for TiN particles to act as fracture initiation sites.

Aluminum is an optional element for the steel of the present invention. Aluminum is a strong deoxidizer and also forms precipitates dispersed in the steel as nitrides which prevent the austenite grain growth. But the deoxidizing effect saturates for aluminum content in excess of 0.1%. A content of more than 0.1% can lead to the occurrence of coarse aluminum-rich oxides that deteriorate tensile properties and especially impact toughness. It is preferable to have aluminum between 0% and 0.06% and more preferably 0% and 0.05%.

Molybdenum is an optional element that can be present from 0.03% to 0.5% in the present invention. Molybdenum forms $Mo_2C$ precipitates which increase the yield strength of the steel of the present invention. Molybdenum has also an obvious effect on steel hardenability. Such an effect is only feasible with a minimum of 0.03% of molybdenum. The excessive addition of molybdenum increases the alloying cost and the formation of MA constituents from retained austenite will be enhanced. Moreover, segregation issue can appear if Mo content is too high. Thus molybdenum is restricted to 0.5% for the present invention. The preferred limit for the steel of the present invention is between 0.03% and 0.3% and more preferably between 0.03% and 0.1%.

Copper is a residual element coming from electrical arc furnace steel making process and must be always kept below 0.5% an preferably reduced down to 0. Over this value, the hot workability decreases significantly.

Niobium is an optional element that can be present in the steel of the present invention from 0.04% to 0.15%. Niobium is added to increase the steel hardenability by delaying strongly diffusive transformation when in solid solution. Niobium can also been used in synergy with boron, preventing boron to precipitate in boro-carbides along the grain boundaries, thanks to preferential precipitation of niobium carbo-nitrides. Moreover niobium is known to slow down recrystallization and austenite grain growth kinetics both in solid solution and in precipitates. The combined effect on austenite grain size and hardenability helps in refining the final martensite microstructure, thereby to increase strength and toughness of parts manufactured according to the present invention. It cannot be added to higher content than 0.15% wt to prevent the coarsening of niobium precipitates that can act as nuclei for ductile damaging and for ferrite transformation.

Titanium is an optional element that can be present from 0.01% to 0.1%. Titanium prevents boron to form nitrides. Titanium precipitates as nitrides or carbo-nitrides in the steel that can efficiently pin austenite grain boundaries and so limit the austenite grain growth at high temperature. As the martensite grain size is closely linked to the austenite grain size, addition of titanium is effective in improving toughness. Such effect is not obtained with titanium content of less than 0.01% and for content of more than 0.1% the effect tends to saturate, whereas only the alloy cost increases. In addition, the occurrence of coarse titanium nitrides formed during solidification is harmful for impact toughness and fatigue properties. Hence the presence of titanium is preferred between 0.01% and 0.03%.

Vanadium is an optional element and present between 0% and 0.5%. Vanadium is effective in enhancing the strength of steel by forming carbides or carbo-nitrides and the upper limit is 0.5% due to the economic reasons. A preferred limit for vanadium is between 0% and 0.1%

Boron ranges from 0.0015 to 0.004%. Boron is usually added in very small quantity since only a few ppm can lead to significant structural changes. With this level of addition, boron has no effect in the bulk because of the very low ratio of boron atom per iron atom (generally <0.00005) and so does not lead to solid solution hardening or precipitation strengthening. In fact, boron strongly segregates at the austenite grain boundaries where, for large grain size, boron atoms can be as numerous as iron atoms. This segregation leads to the retardation of ferrite and pearlite formation that promotes martensitic microstructures during cooling and thus increases the strength of such steels after austenite decomposition at moderate cooling rates. To allow and exhibit this effect, it is recommended to add B in an amount of 0.0015% or more. Higher boron content rapidly deteriorates the low temperature toughness of such steels, so an upper limit thereof is set at 0.004%.

Other elements such as Tin, Cerium, Magnesium or Zirconium can be added individually or in combination in the following proportions by weight: Tin ≤0.1%, Cerium≤0.1%, Magnesium≤0.010% and Zirconium≤0.010%. Up to the maximum content levels indicated, these elements make it possible to refine the grain during solidification. The remainder of the composition of the Steel consists of iron and inevitable impurities resulting from processing.

The microstructure of the Steel sheet, in area fraction, comprises:

Martensite in the steel of the present invention is from 55% to 85%. Martensite is the matrix phase of the steel of the present invention. Martensite provides the steel with tensile strength and other mechanical properties. To achieve a tensile strength of 1300 MPa a minimum of 55% martensite is required. It is advantageous to have martensite between 60% and 85% and preferably between 65% and 80%. Martensite is formed during the second step of cooling especially between Ms—150° C. and room temperature. The martensite of the present invention comprises of Fresh martensite, stress relieved martensite.

Auto-Tempered Martensite is present in the steel of the present invention between 20% and 45%. Auto-tempered martensite is an essential micro-constituent of the steel of the present invention. Auto-tempered martensite imparts the steel of the present invention with impact toughness and ductility. A minimum of 20% of auto-tempered martensite is required to achieve the impact toughness but whenever the auto-tempered martensite is more than 45% the tensile strength diminishes. Hence the preferred presence of the auto-tempered martensite is between 25% and 40% and more preferably between 30% and 40%. The auto-tempered martensite of the steel of the present invention is formed from the martensite obtained at the end of the first step of cooling that gets self-tempered during the second step of cooling, through the exothermic reaction going on during the cooling because of the formation of Martensite.

The distinction between the auto tempered martensite and martensite is confirmed by use of LePera etching that revealed both phases and then using an SEM observe the carbides in the auto-tempered martensite. For example in FIG. 1 numeral 10 shows the auto tempered martensite in which the carbides are distinctly visible as tiny white spots and numeral 20 shows the martensite where there is no carbide presence.

The cumulated amounts of martensite and auto-tempered martensite is at least 90% and preferably 95% to ensure simultaneously tensile strength and impact toughness. Martensite of the present invention imparts tensile strength and auto tempered martensite imparts the toughness, whenever the cumulative presence is less than 90% the presence of soft phase such as Residual austenite increases which is detrimental for both tensile strength and toughness.

Residual austenite can be present in the steel from 0% to 10% and should be kept as minimum as possible. Residual Austenite up to 10% is not detrimental to the targeted properties but when present above 10% it adversely impacts the tensile strength. It is preferred to have residual austenite from 0% to 5% and more preferably 0% to 2%.

In addition to the above-mentioned microstructure, the microstructure of the mechanical forged part is free from microstructural components such as bainite, pearlite and cementite.

A mechanical part according to the invention can be produced by any suitable hot forging process, for example drop forging, press forging, upset forging and roll forging, in accordance with the stipulated process parameters explained hereinafter.

A preferred exemplary method is demonstrated herein but this example does not limit the scope of the disclosure and the aspects upon which the examples are based. Additionally, any examples set forth in this specification are not intended to be limiting and merely set forth some of the many possible ways in which the various aspects of the present disclosure may be put into practice.

A preferred method consists in providing a semi-finished casting of steel with a chemical composition according to the invention. The casting can be done in any form such as ingots or blooms or billets which is capable of being forged in mechanical part that possess a cross section diameter between 30 mm and 100 mm.

For example, the steel having the above-described chemical composition is casted in to a bloom and then rolled in form of a bar which will act as a semi-finished product. Several operations of rolling can be achieved to obtain the desired semi-finished product.

The semi-finished product after the casting process can be used directly at a high temperature after the rolling or may be first cooled to room temperature and then reheated for hot forging at a temperature ranging from Ac3+30° C. to 1300° C.

The temperature of the semi-finished, which is subjected to hot forging, is preferably at least 1150° C. and must be below 1300° C. because the temperature of the semi-finished product is lower than 1150° C., excessive load is imposed on forging dies and, further, the temperature of the steel may decrease to a Ferrite transformation temperature during finishing forging, whereby the steel will be forged in a state in which transformed Ferrite contained in the structure. Therefore, the temperature of the semi-finished product is preferably sufficiently high so that hot forging can be completed in the austenitic temperature range. Reheating at temperatures above 1300° C. must be avoided because they are industrially expensive.

A final finishing forging temperature, herein after referred as Tforging, must be kept above 950° C. to have a structure that is favorable to recrystallization and forging. It is preferred to have final forging to be performed at a temperature greater than Ac3+50° C. and preferably above Ac3+100° C. because below this temperature the steel sheet exhibits a significant drop in forging.

The hot forged part is thus obtained in this manner and then this hot forged steel part is cooled in a two-step cooling process.

In the two-step cooling process of the hot forged part, the hot forged part is cooled at different cooling rates between different temperature ranges.

In step one of cooling, the hot forged part is cooled from Tforging to a temperature range from 750° C. to 1250° C., herein also referred as T1 at an average cooling rate from 0.2° C./s to 10° C./s. The part can optionally be held at T1 for up to 3600 s. During this step one of cooling, it is preferred to have an average cooling rate from Tforging to T1 ranging from 0.2° C./s to 8° C./s and more preferably from 0.2° C./s to 2° C./s Thereafter, the second step of cooling starts wherein the hot forged part is cooled from ge T1 to a temperature herein referred as T2and ranging from Ms—150° C. to room temperature, at an average cooling rate from 0.1° C./s to 10° C./s. During the step two of cooling, the cooling between T1 to T2 is preferably kept at an average cooling rate of 1.0° C./s to 5.0° C./s. Such second step of cooling is there to promote the transformation of Austenite into Martensite as well as to auto-temper the already formed martensite, lowering the possibility of retaining austenite in the final microstructure. This average cooling rate is also chosen in order to perform homogenous cooling across the cross-section of the hot forged part.

After completion of the second step of cooling the forged mechanical part is obtained.

The forged mechanical part obtained can be optionally tempered from 100° C. to 200° C./s during 5 seconds to 3600 seconds and preferably from 125° C. to 200° C.

For all the steps of cooling, the Ms Temperatures is calculated for the present steel by using the following formula:

$$Ms=539-423C-30Mn-18Ni-12Cr-11Si-7Mo$$

wherein the elements contents are expressed in weight percent.

EXAMPLES

The following tests, examples, figurative exemplification and tables which are presented herein are non-restricting in nature and must be considered for purposes of illustration only, and will display the advantageous features of the present invention.

Forged mechanical part made of steels with different compositions is gathered in Table 1, where the forged mechanical part is produced according to process parameters as stipulated in Table 2, respectively. Thereafter Table 3 gathers the microstructures of the forged mechanical part obtained during the trials and table 4 gathers the result of evaluations of obtained properties.

TABLE 1

| | Composition | | | | | | | | | | | | | |
|---|---|---|---|---|---|---|---|---|---|---|---|---|---|---|
| Steel Sample | C | Mn | Si | Cr | Ni | S | P | N | Al | Mo | Nb | Ti | V | B |
| 1 | 0.18 | 1.77 | 0.77 | 1.11 | 0.46 | 0.015 | 0.01 | 0.012 | 0.020 | 0.08 | 0.07 | 0.027 | 0 | 0 |
| 2 | 0.42 | 0.80 | 0.19 | 1.05 | 0 | 0.007 | 0.01 | 0.050 | 0.032 | 0.19 | 0 | 0.003 | 0 | 0 |
| 3 | 0.50 | 0.90 | 0.25 | 1.10 | 0.07 | 0.007 | 0.01 | 0.008 | 0.030 | 0 | 0 | 0 | 0.12 | 0 |
| 4 | 0.30 | 1.20 | 0.25 | 0.35 | 0.20 | 0.015 | 0.01 | 0 | 0.030 | 0.12 | 0 | 0.05 | 0 | 0.005 |

Table 2 gathers the process parameters implemented on semi-finished product made of steels of Table 1 after being reheating at 1280° C. and then hot forged. The Steel compositions I11 to I13 serve for the manufacture of forged mechanical part according to the invention. This table also specifies the reference forged mechanical parts which are designated in table from R1 to R3. Table 2 also shows tabulation of Ms and Ac3.

TABLE 2

| | | | process parameters | | | | | | |
|---|---|---|---|---|---|---|---|---|---|
| | | | Step 1 | | Step 2 | | | | |
| | | | Average | | | | | | |
| Trials | Steel | Tforging (° C.) | Cooling rate from Tforging to T1 (° C./s) | T1 (° C.) | Average Cooling rate from T1 to T2 (° C./s) | T2 (° C.) | Tempering Temperature | Ac3 (° C.) | Ms (° C.) |
| I1 | 1 | 1250 | 0.9 | 1200 | 3 | 25 | — | 875 | 425 |
| I2 | 1 | 1250 | 0.9 | 1200 | 3 | 25 | — | 875 | 425 |
| I3 | 1 | 1200 | 0.9 | 880 | 3 | 25 | — | 875 | 425 |
| R1 | 2 | 1200 | 0.9 | 850 | 3 | 25 | 550 | 800 | 325 |
| R2 | 3 | 1200 | 0.9 | 840 | 3 | 25 | 560 | 778 | 291 |
| R3 | 4 | 1200 | 0.9 | 900 | 3 | 25 | 425 | 772 | 380 |

I = according to the invention;

R = reference;

underlined values: not according to the invention.

TABLE 3

| Microstructure | | | | | | |
|---|---|---|---|---|---|---|
| Trials | Steel Sample | Martensite (%) | Auto-Tempered Martensite (%) | Martensite + Auto-Tempered Martensite (%) | Residual Austenite (%) | Bainite (%) |
| I1 | 1 | 69 | 31 | 100 | 0 | 0 |
| I2 | 1 | 67 | 33 | 100 | 0 | 0 |
| I3 | 1 | 70 | 30 | 100 | 0 | 0 |
| R1 | 1 | 100 | 0 | 100 | 0 | 0 |
| R2 | 2 | 100 | 0 | 100 | 0 | 0 |
| R3 | 3 | 100 | 0 | 100 | 0 | 0 |

I = according to the invention;
R = reference;
underlined values: not according to the invention.

Table 3 exemplifies the results of the tests conducted in accordance with the standards on different microscopes such as Scanning Electron Microscope for determining the microstructures of both the inventive and reference steels in terms of area fraction.

The results are stipulated herein:

Table 4 exemplifies the mechanical properties of both the inventive steel and reference steels. In order to determine the tensile strength, yield strength tensile tests are conducted in accordance of NF EN ISO 6892-1 standards. Tests to measure the impact toughness for both inventive steel and reference steel are conducted in accordance of EN ISO 148-1 at 20° C. on V-notched standard KCV specimen.

The results of the various mechanical tests conducted in accordance to the standards are gathered

TABLE 4

| Properties | | | | |
|---|---|---|---|---|
| Trials | UTS (MPa) | Impact toughness KCV 20° C. (J) | YS (MPa) | YS/TS |
| I1 | 1463 | 46 | 1023 | 0.70 |
| I2 | 1470 | 40 | 1031 | 0.70 |
| I3 | 1468 | 44 | 1037 | 0.71 |
| R1 | 1231 | 52 | 1178 | 0.95 |
| R2 | 1214 | 39 | 1129 | 0.93 |
| R3 | 1185 | 37 | 1128 | 0.95 |

I = according to the invention;
R = reference; underlined values: not according to the invention.

What is claimed is:

1. A steel for forging mechanical parts having a composition comprising the following elements, expressed in percentage by weight:

$0.04\% \leq C \leq 0.28\%$;

$1.2\% \leq Mn \leq 2.2\%$;

$0.3\% \leq Si \leq 1.2\%$;

$0.5\% \leq Cr \leq 1.5\%$;

$0.01\% \leq Ni \leq 1\%$;

$0\% \leq S \leq 0.06\%$;

$0\% \leq P \leq 0.02\%$;

$0\% \leq N \leq 0.015\%$;

and optionally one or more of the following elements $0\% \leq Al \leq 0.1\%$;

$0.03\% \leq Mo \leq 0.5\%$;

$0\% \leq Cu \leq 0.5\%$;

$0.04\% \leq Nb \leq 0.15\%$;

$0.01\% \leq Ti \leq 0.1\%$;

$0\% \leq V \leq 0.5\%$;

$0.0015\% \leq B \leq 0.004\%$;

a remainder of the composition being iron and unavoidable impurities caused by processing, a microstructure of the steel consisting of, in area fraction, 55% to 80% of Martensite, 20% to 45% of Auto-tempered Martensite, 0 to 10% Residual Austenite and, wherein a cumulated amount of Auto-tempered martensite and martensite is at least 90%.

2. The steel as recited in claim 1 wherein the composition includes 0.3% to 0.9% of Silicon, by weight.

3. The steel as recited in claim 1 wherein the composition includes 0.08% to 0.25% of Carbon, by weight.

4. The steel as recited in claim 1 wherein wherein the composition includes 0% to 0.06% of Aluminum, by weight.

5. The steel as recited in claim 1 wherein the composition includes 1.4% to 2.1% of Manganese, by weight.

6. The steel as recited in claim 1 wherein the composition includes 0.7% to 1.4% of Chromium, by weight.

7. The steel as recited in claim 1 wherein the the martensite content is from 60% to 80% in area fraction.

8. The steel as recited in claim 1 wherein the cumulative presence of Auto-tempered martensite and martensite is at least 95% in area fraction.

9. The steel as recited in claim 1 wherein the steel has an ultimate tensile strength of 1300 MPa or more and an impact toughness greater than or equal to 38 J/cm$^2$ at 20° C.

10. A method of producing forged mechanical parts of the steel as recited in claim 1 comprising the following successive steps:

providing a semi-finished product having the composition;

reheating the semi-finished product to a temperature from Ac3+30° C. to 1300° C.;

hot forging the semi-finished product in the austenitic range wherein the Tforging temperature is above 950° C. to obtain a hot forged part;

cooling the hot forged part in a two-step cooling, wherein in step one the hot forged part is cooled at an average cooling rate from 0.2° C./s to 10° C./s from Tforging temperature to a temperature T1 ranging from 780 to 1250° C., where the hot forged part can be held optionally up to 3600 s and thereafter in step two the hot forged part is cooled at an average cooling rate from 0.1° C./s to 10° C./s from T1 to a temperature T2 ranging from Ms-150° C. to room temperature to obtain a forged mechanical part.

11. The method as recited in claim 10 wherein in the step one of cooling the hot forged part is cooled at an average cooling rate from 0.2° C./s to 8° C./s from Tforging to T1.

12. The method as recited in claim 10 wherein in the step two of cooling the hot forged part is cooled at an average cooling rate from 1.0° C./s to 5.0° C./s from T1 to T2.

13. The method as recited in claim 10 further comprising a tempering performed in a range from 100° C. to 200° C.

14. A steel sheet made of the steel as recited in claim 1 for the manufacture of structural or safety parts of a vehicle or an engine.

15. A forged mechanical part produced according to the method as recited in claim 10 for the manufacture of structural or safety parts of a vehicle or an engine.

16. A vehicle comprising the forged mechanical part as recited in claim 15.

17. The steel as recited in claim 1, wherein the microstructure of the steel consists of, in area fraction, 60% to 75% of Martensite, 25% to 40% of Auto-tempered Martensite, 0 to 10% Residual Austenite and, wherein a cumulated amount of Auto-tempered martensite and martensite is at least 90%.

18. The steel as recited in claim 1, wherein the microstructure of the steel consisting of, in area fraction, 60% to 70% of Martensite, 30% to 40% of Auto-tempered Martensite, 0 to 10% Residual Austenite and, wherein a cumulated amount of Auto-tempered martensite and martensite is at least 90%.

* * * * *